United States Patent [19]

Eiermann

[11] Patent Number: 4,790,734

[45] Date of Patent: Dec. 13, 1988

[54] RADIAL SEAL OF A ROTARY PISTON ENGINE

[75] Inventor: Dankwart Eiermann, Weissenberg-West, Fed. Rep. of Germany

[73] Assignee: Wankel GmbH, Berlin, Fed. Rep. of Germany

[21] Appl. No.: 90,314

[22] Filed: Aug. 27, 1987

[30] Foreign Application Priority Data

Aug. 30, 1986 [DE] Fed. Rep. of Germany ..... 3629654

[51] Int. Cl.[4] ..... F01C 19/04

[52] U.S. Cl. ..... 418/123

[58] Field of Search ..... 418/122–124, 418/112, 113

[56] References Cited

U.S. PATENT DOCUMENTS

| | | | |
|---|---|---|---|
| 3,176,909 | 4/1965 | Maurhoff | 418/123 |
| 4,403,930 | 9/1983 | Kodama | 418/121 |

FOREIGN PATENT DOCUMENTS

| | | | |
|---|---|---|---|
| 716348 | 8/1965 | Canada | 418/123 |
| 1223614 | 8/1966 | Fed. Rep. of Germany | 418/123 |
| 990709 | 4/1965 | United Kingdom | 418/123 |
| 1016908 | 1/1966 | United Kingdom | 418/122 |

*Primary Examiner*—John J. Vrablik

*Attorney, Agent, or Firm*—Becker & Becker, Inc.

[57] ABSTRACT

A radial seal for a rotary piston engine having a trochoidal-shaped casing inner surfacing and a multi-corner piston with which sealing strips are arranged in radial grooves in the corners of the piston. The sealing strips engage under pressure of the operating chambers against the casing inner peripheral surfacing and respectively against the lower-pressure-side groove wall. The sealing strips have perforations or openings between the sealing surfaces coming into engagement along the groove walls. Filler pieces are inserted or installed with nominal clearance in the perforations or perforations in the sealing strip. These filler pieces are narrower in peripheral direction in the dimensioning or measurement thereof compared with the sealing strip. A spring holds the filler pieces in continuous engagement against an upper part of the sealing strip. Groove clearance of the sealing strip amounts to a value in a range of 0.04 to 0.08 mm and the groove clearance of the filler pieces amounts to a value in a range of 0.1 to 0.2 mm.

5 Claims, 2 Drawing Sheets

RADIAL SEAL OF A ROTARY PISTON ENGINE

BACKGROUND OF THE INVENTION

1. Field of the Invention

The present invention relates to a radial seal of a rotary piston engine with a trochoidal-shaped mantel raceway or casing inner peripheral surfacing and a multi-corner piston means. Sealing strips are arranged in radial grooves in the corners of the piston means; the sealing strips under pressure of the working or operating chambers of the rotary piston engine engage against the mantel raceway or casing inner peripheral surfacing and respectively also engage against an under-pressure-side groove wall. The sealing strips have perforations or breakthroughs in the sealing surfaces thereof coming into engagement along the groove walls.

2. Description of the Prior Art

Such sealing strips are exposed and subjected to a tipping, tilting or pitching moment under the working or operating pressure effective upon a part or portion of the sealing strips projecting beyond the groove edges and under the effect or result of rolling friction, rubbing or abrasion of the crest, arch, dome or apex thereof along the mantel raceway or casing inner peripheral surfacing along which the sealing strips move; such tipping, tilting or pitching moment can lead to jamming of the sealing strip in the groove and with that can lead to hindrance or restraint of movement, to hammering, to leakiness and to undue wear on the sealing strip and mantel raceway or casing inner peripheral surfacing.

Consequently an endeavor or effect is made to keep and maintain the groove clearance of the sealing strip as small as possible in order to prevent any tipping, tilting or pitching of the seal strip. With a groove clearance that is too small or nominal however, the groove gap resulting on the pressure side along the low-pressure-side groove wall during engagement of the sealing strip is too narrow in order to permit and allow the working or operating pressure in the groove base or bottom to reach or come below the sealing strip in a timely manner. The sealing strip then cannot seal-off with full pressure of engagement with respect to the mantel raceway or casing inner peripheral surfacing.

In order to eliminate or remove this disadvantage, there was proposed in German Pat. No. 12 23 614 Paschke dated Mar. 9, 1967 (corresponding to U.S. Pat. No. 3,185,387—Paschke dated May 25, 1965) to reduce the cross section of the radially inner part of the sealing strip in peripheral direction with respect to the upper part coming into engagement against the groove walls in the region of the groove edges and additionally in the lower part to provide continuous perforations or breakthrough means in peripheral direction, whereby the space for the flowing-in of the pressure gas is adequately enlarged. The arrangement of such large spaces or chambers however results in the disadvantage that the filling-up thereof with pressure gas requires a time delay, which does not permit and allow an intermediate seal effectiveness, which most of all is important at higher rotary speeds. The aforementioned German Patent consequently already proposes to close the recess spaces or chambers between the sealing strip and the groove with filler pieces (fairing) or corresponding configurations and construction of the groove base or bottom. This in itself is a contradiction to the teaching of this patent disclosure and this proposal is not adequately explained either in the description or in the drawings. The proposed recesses, notches, cutouts or openings additionally have the disadvantage that the under-pressure-side sealing surface is too small between the sealing strip and the groove wall.

In the U.S. Pat. No. 4,403,930—Kodama dated Sept. 13, 1983 for a Multi-Piece Apex Seal Structure for a Rotary Piston Engine there is proposed a sealing strip which is divided in a plane located in peripheral or circumferential direction, with which the radially inner part is narrower with respect to the radially outer part adjoining or engaging against the mantel raceway or casing inner peripheral surfacing and is shiftable in circumferential or peripheral direction.

The lower part of the seal length strip is shifted toward the under-pressure-side groove wall via the operating pressure, whereby an expanded or widened access or entry pass into the groove base is obtained for the pressure gas, without receiving too wide and only belated fillable spaces or chambers. Additionally, there results a greater elasticity and close contact or adhesion of the sealing strip with respect to temperature-conditioned or temperature-limited unevenness and distortion of the mantel raceway or casing inner peripheral surfacing.

The advantage of the narrowing or constriction of the groove made possible therewith however is again nullified by the considerable shortening of the sealing strip in radial direction, since only the radially outer part of the sealing strip can be considered, because the possible canting or tipping angle is enlarged with radial shortening of the sealing strip with a given groove width.

An object of the present invention accordingly is to provide a sealing strip, with which an adequate or sufficiently quick access or entry of the pressure gas underneath the sealing strip is made possible; this occurs with the smallest possible dead-space formation being encountered therewith; furthermore a wide-surface engagement of the under-pressure-side thereof against the groove wall is attained therewith also provided are higher elasticity and close contact and snug adherence as to the unevenness and distortions of the mantel runway or casing inner peripheral surfacing. This object is met and fulfilled with the features of the present invention.

BRIEF DESCRIPTION OF THE DRAWINGS

This object, and other objects and advantages of the present invention, will appear more clearly from the following specification in conjunction with the accompanying drawings, in which.

DESCRIPTION OF PREFERRED EMBODIMENTS

Figure 1:
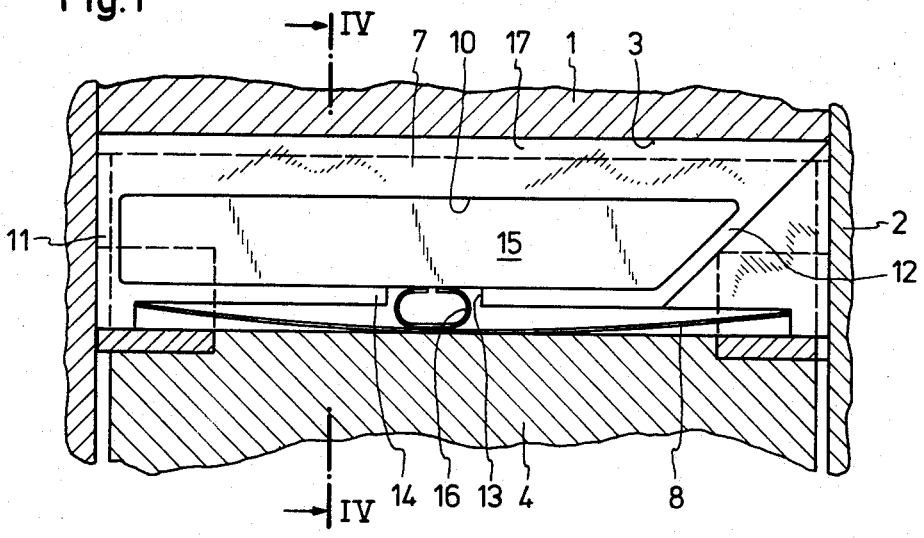
FIG. 1 is a view that shows a partial radial section through a rotary piston engine with inventive structural embodiment of the corner seal and taken in a plane I—I in FIG. 4.

FIG. 1 shows a housing mantel or casing 1, having a housing sidewall 2 and also having a mantel raceway or casing inner peripheral surfacing 3. A triangular piston 4 in an illustrated corner 5 thereof has a radial groove 6 in which a sealing strip 7 is arranged radially movable and shiftable in peripheral or circumferential direction; and the sealing strip 7 is pressed against the mantel raceway or casing inner surfacing 3 by a spring 8 as well as by pressure gas from the preceding operating chamber 9. In the sealing strip 7 there is provided a circumferentialy continuous perforation, passage or open breakthrough 10, which as apparent in a lateral plan view is limited in axial direction by edge webs or cross-pieces 11 and 12 as well as on a radially inner side thereof by an edge strip 14 having an opening or perforation 13 broken therethrough. In the perforation 10 there is a filler piece 15 of lightest possible material, for example of aluminum or temperature resistant synthetic material installed with a small or nominal clearance. A round or annular spring 16 engages in the perforation 13 of the edge strip 14. This annular or elongated spring 16 is supported upon the other side against the spring 8 and can be connected therewith. The spring 16 presses the filler piece 15 with a radially outer edge thereof against an upper part 17 of the sealing strip 7. The filler piece 15 is narrower in measurement or dimension in peripheral direction than the sealing strip 7, which is equally thick in all of the parts 17, 11, 12 and 14 thereof. The filler piece 15 as a consequence of clearance thereof is movable to a certain or predetermined extent in radial direction. The filler piece 15 however is pressed by the annular spring 16 and the gas pressure against the upper part 17 of the sealing strip 7. Consequently, the sealing strip 7 and filler piece 15, with respect to the sealing effect thereof, actually represent a unitary sealing strip acting in common.

Figure 4:
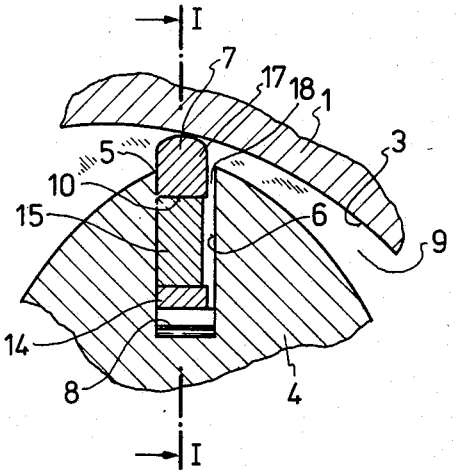
FIG. 4 is a view that shows a partial axial section through a piston corner seal according to FIG. 3 taken in a plane IV—IV similar to that in FIG. 1.

During pressure impingement or engagement from one side, for example as shown in FIG. 4, and taken from the preceding operating chamber 9, there is noted that the lighter filler piece 15 is pressed against the lower-pressure-sidewall of the groove 6 and with that there is attained a valve effect. Thereupon the sealing strip 7 having a greater mass is pushed subsequently or follows against this groove wall, whereby via the retraction of the filler piece 15 with respect to the sealing strip 7 there is formed a sufficiently and adequately large pass or passage 18 for pressure gas in the groove base or bottom and under the sealing strip, although this pass or passage 18 contains no unnecessary dead spaces or chambers. The width of the groove 6 consequently can be kept and maintained so small that a binding or jamming tipping, canting or tilting of the sealing strip 7 is avoided, whereby the filler piece 15 as a consequence of its tight engagement against the upper part 17 of the sealing strip 7 cooperates as a lever arm against the tipping, tilting or canting of the sealing strip 7. As a consequence of the continuous radial longitudinal expansion of the sealing strip there is noted that tipping or tilting thereof is readily restricted and limited.

For purposes of illustration and as an example there can be set forth as advantageous dimensions and measurements the following values:

groove clearance of the sealing strip 7 for example in a range of 0.04 to 0.08 mm;

groove clearance of the filler piece 15 for example in a range of 0.1 to 0.2 mm.

The filler piece 15 accordingly can be narrower by a range of 0.2 to 0.3 mm than the thickness of the sealing strip 7.

Figure 2:
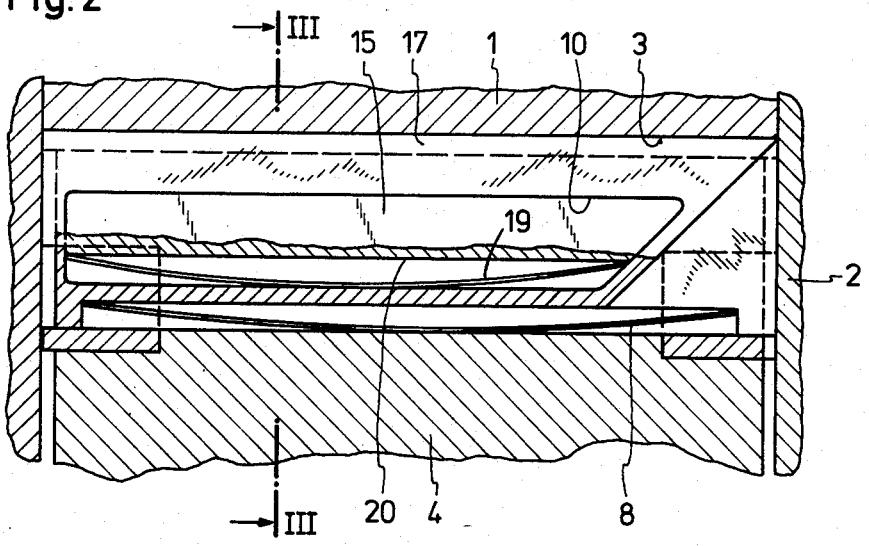
FIG. 2 is a view that shows a partial axial section through another embodiment of the piston corner seal with a view of the sealing strip being taken in a plane II—II in FIG. 3.
Figure 3:
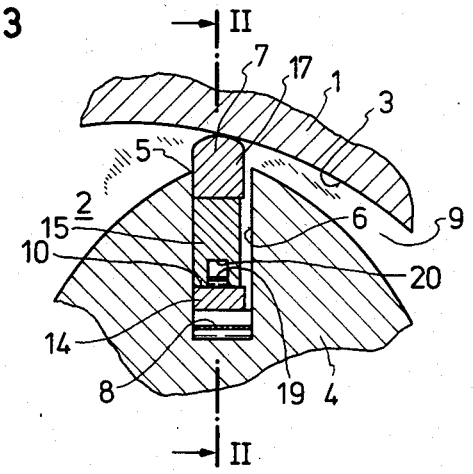
FIG. 3 is a view that shows a radial section through another embodiment of the present inventive piston corner seal taken in a plane III—III similar to that shown in FIG. 2.

As shown in FIGS. 2 and 3 the spring 16 pressing the filler piece 15 radially outwardly can be arranged as a spring 19 in an axial groove 20 in the underside of the filler piece 15, so that the perforation, passage or breakthrough 13 of the lower edge strip 14 of the sealing strip 7 is unnecessary.

Figure 5:
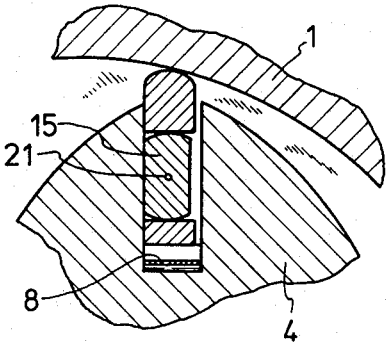
FIG. 5 is a view that shows a radial section through another embodiment of a present inventive sealing strip.

As shown in FIG. 5 the filler piece 15 can be rounded off in oppositely located curved configurations along a radially upper side and a radially inner side thereof radially outwardly and radially inwardly of a middle or center axis 21; these curved configurations are to prevent and preclude a jamming during a temporary tipping in an engaging movement thereof in the perforation or breakthrough 10.

The sealing strips described in the foregoing sample embodiments in spite of having a radial width equal with respect to the solid or unitary sealing strips can have an increase or elevated elasticity and close contact, snug adherence capability.

In summary, the present invention provides a radial seal for a rotary piston engine with a trochoidal-shaped mantel raceway or casing inner peripheral surfacing as well as a multi-corner piston means, with which sealing strips are arranged in radial grooves in corners of the piston means. These sealing strips under pressure of the operating chambers engage against the mantel raceway or casing inner peripheral surfacing and respectively against the lower-pressure-side groove wall; and the sealing strips have perforations, passages or breakthroughs between the sealing surfaces coming into engagement against the groove walls. The radial seal is further characterized thereby that narrower filler pieces 15 are inserted or installed with nominal clearance in at least one perforation or breakthrough 10 in the sealing strip. The filler pieces 15 are narrower in the dimension or measurement thereof in peripheral direction when compared with the dimension or measurement of the sealing strip in peripheral direction. A spring 16, 19 holds the filler pieces 15 in continuous engagement against an upper part 17 of the sealing strip 7. The groove clearance of the sealing strip 7 amounts to a value in a range of 0.04 to 0.08 mm and the groove clearance of the filler pieces 15 amounts to a value in a range of 0.1 to 0.2 mm.

In FIG. 1 the radially inner edge strip 14 of the sealing strip 7 has perforations or breakthrough means 13, through which springs 16 engage pressing the filler pieces 15 against the upper part 17 of the sealing strip 7.

In FIG. 2 the filler pieces 15 along a radially lower side thereof have a groove 20 extending in axial direction; a spring 19 is installed or inserted in this groove 20 and this spring 19 presses the filler pieces 15 against the upper part 17 of the sealing strip 7.

In FIG. 5 the filler pieces 15 are rounded-off about the center axis 21 thereof along the radially outer and inner edges thereof.

The present invention is, of course, in no way restricted to the specific disclosure of the specification and drawing, but also encompasses any modifications within the scope of the appended claims.

What I claim is:

1. A radial seal for a rotary piston engine having a trochoidal-shaped casing inner surfacing and multicorner piston means, with which sealing strips are arranged in radial grooves having groove walls including groove side walls in the corners of the piston means; the sealing strips engage under pressure of the operating chambers against the casing inner surfacing and respectively against a groove side wall dependent upon direction of higher pressure-respectively lower-pressure relationship therewith; and the sealing strips have radially separate sealing strip pieces and have perforations between sealing surfaces which are lying in the groove and come into engagement against the groove walls; the improvement therewith comprising:

filler pieces disposed in between radially separate sealing strip pieces, said filler pieces being installed with nominal clearance in the perforations in the sealing strip, said filler pieces being narrower in peripheral direction than the dimensioning of the sealing strip; and a spring means holding the filler pieces in continuous engagement along an upper part of said sealing strip.

2. A radial seal according to claim 1, in which each radial groove includes radial side walls as well as a groove bottom relative to which groove clearance of the sealing strip with the side walls amounts to a value in a range of 0.04 to 0.08 mm and groove clearance of the filler piece with the side walls amounts to a value in a range of 0.1 to 0.2 mm.

3. A radial seal according to claim 2, in which said sealing strips each include an upper part thereof as well as a radially inner edge strip of said sealing strip having openings therethrough and said spring means engage therein for pressing the filler pieces against the upper part of the sealing strip.

4. A radial seal according to claim 2, in which said sealing strips each include an upper part thereof and said filler pieces each include a radially lower side and along the radially lower side have a groove extending in axial direction; and a spring is inserted in said latter groove and presses said filler pieces against the upper part of the sealing strip.

5. A radial seal according to claim 2, in which said filler pieces have sides including a middle and radially outer as well as radially inner edges, said radially outer as well as said radially inner edges being rounded off in oppositely located curved configurations along the radially outer and inner edges thereof at locations radially outwardly and radially inwardly of the middle of the filler pieces respectively

* * * * *